United States Patent [19]

Jagst

[11] 4,190,933

[45] Mar. 4, 1980

[54] APPARATUS FOR BREAKING TEXTILE FIBER BALES

[75] Inventor: Peter Jagst, Mönchen-Gladbach, Fed. Rep. of Germany

[73] Assignee: Trutzschler GmbH & Co. KG., Mönchen-Gladbach, Fed. Rep. of Germany

[21] Appl. No.: 885,895

[22] Filed: Mar. 13, 1978

[30] Foreign Application Priority Data

Mar. 12, 1977 [DE] Fed. Rep. of Germany ..... 2710962

[51] Int. Cl.[2] ..... D01G 7/04

[52] U.S. Cl. ..... 19/81; 19/145.5; 241/101 A

[58] Field of Search ..... 19/80 R, 81, 145.5; 241/101.7, 101 A

[56] References Cited

U.S. PATENT DOCUMENTS 3,660,866 5/1972 Vagst ..... 19/81

FOREIGN PATENT DOCUMENTS 952672 3/1964 United Kingdom ..... 19/80 R

*Primary Examiner*—Louis Rimrodt

*Attorney, Agent, or Firm*—Spencer & Kaye

[57] ABSTRACT

An apparatus for breaking textile fiber bales includes a plurality of spiked breaker members each rotated in a working direction and spaced from one another in the working direction and a support for receiving a series of juxtapositioned bales in the working direction above the breaker members for exposing the underside of the bales to the breaker members. The support comprises a flexible underlay which extends in the working direction for engaging face-to-face the underside of the bales and which is prevented from displacement in the working direction. An arrangement forms an upwardly open chamber of one part of the flexible underlay. The breaker members are accommodated in the chamber for engaging the underside of the bales situated at least in part within the outline of the chamber opening. The chamber and the breaker members are moved as a unit in the working direction along the bales.

15 Claims, 4 Drawing Figures

APPARATUS FOR BREAKING TEXTILE FIBER BALES

BACKGROUND OF THE INVENTION

This invention relates to an apparatus for breaking textile fiber bales in which a plurality of serially arranged textile fiber bales are, at their underside, opened by at least two closely spaced and serially arranged endless spiked aprons or spiked rolls (hereafter designated as breaker members). The spikes of any breaker member are inclined in a direction opposite to the inclination of the spikes belonging to an adjacent breaker member.

In a known bale breaker, a series of textile fiber bales are, by means of closely spaced, serially arranged conveying means, moved back and forth while they are being opened at their underside. In such an apparatus, the breaker members serve simultaneously as conveying means and as bale openers. Further, in such an arrangement, the bales are situated directly on the conveying means and are moved back and forth during the bale breaking process. The number of the conveying means approximately corresponds to that of the bales handled simultaneously. With such a simple bale breaker, a high efficiency in the breaking and mixing of the textile fiber bales may be achieved. As a rule, in such a bale breaker apparatus, there are provided two parallel-spaced bale guiding walls which extend in the working direction, preventing a lateral toppling of the bales which, in most cases, are unstable after the bale ties are removed. Viewing in the working direction, the bales are adjoined by other unstable bales, so that under certain conditions it is conceivable that a bale may topple in the working direction as well.

SUMMARY OF THE INVENTION

It is an object of the invention to provide an improved apparatus of the above-outlined type which prevents a toppling of the bales with inexpensive means.

This object and others to become apparent as the specification progresses, are accomplished by the invention, according to which, briefly stated, the apparatus for breaking textile fiber bales includes a plurality of spiked breaker members each rotated in a working direction and spaced from one another in the working direction and a support for receiving a series of juxtapositioned bales in the working direction above the breaker members for exposing the underside of the bales to the breaker members. The support comprises a flexible underlay which extends in the working direction for engaging face-to-face the underside of the bales and which is prevented from displacement in the working direction. An arrangement forms an upwardly open chamber of one part of the flexible underlay. The breaker members are accommodated in the chamber for engaging the underside of the bales situated at least in part within the outline of the chamber opening. The chamber and the breaker members are moved as a unit in the working direction along the bales.

In the apparatus outlined above, the parallel belt parts of the spiked aprons are at a standstill during the rotation of the belts, similarly to caterpillars of tracked vehicles. The belts and the spikes arranged thereon are moved only during their deflection about the end rollers. The inclined spikes arranged on the stationary parallel parts of the belts thus dwell immobilized at the underside of the bale. Only by virtue of the semi-circular motion of the belts at the end rollers are parts (tufts) torn from the textile fiber bales by virtue of the downwardly pivoting spikes.

According to the invention, the breaker members are movable back and forth together with the upwardly open chamber defined by one part of the flexible underlay. The latter may be a sheet, a chain (such as a roller chain or rod chain) or both. The textile fiber bales remain, however, stationary during the opening of their underside and, dependent upon the position of the upwardly open chamber and the breaker members, they rest either on the flexible underlay or on the breaker members, or both. At the same time, the spikes of the breaker members penetrate into the underside of the textile fiber bale and dwell in that position until they are moved downwardly by executing a pivotal (flipping) motion. By virtue of this arrangement, so displacement is imparted to the bales by the breaker members, so that the bales cannot tilt in the working direction. In addition, a single pair of driven breaker members is sufficient to open a plurality of serially arranged bales. In this manner, significant economy in the structural design may be achieved which is particularly due to the use of the flexible underlay. It is a further advantage of the apparatus according to the invention that the bales may be arranged in an immediate adjoining series on the apparatus and thus mutually support one another from opposite sides.

It is a further significant advantage of the invention that the opening of the bale is effected from its underside. This zone, including the conveying belt situated underneath the breaker members, may be shielded with simple means from all sides and the thus enclosed space may be vacuumized to thus carry away in a secure manner the dust released during the opening of the bales.

Preferably, the underlay is fixedly attached at both ends. Between its ends the underlay is deflected downwardly by two spaced deflecting rollers and is trained about at least one additional roller arranged below the deflecting rollers at the opposite side of the underlay. In this manner, the underlay forms a loop which defines an upwardly open chamber accommodating the breaker members. The underlay is preferably made of a tear-resistant flexible multilayer material, such as a rubber-coated textile fabric.

The size of the fiber tufts deposited on the conveyor belt may be varied by changing the length of the spikes or, without retooling, by altering the distance between adjoining breaker members. The output rate of the apparatus may be varied by altering the rotational speed of the breaker members.

The breaker members are mounted on a carriage which is displaceable in the working direction (that is, along the serially arranged bales which extend in the length dimension of the apparatus). To ensure versatileness of the apparatus, the speed of the carriage and that of the breaker members are alterable in a stepless manner. Expediently, the drives for the breaker members and the carriage are interconnected in such a manner that the rotational speed of the breaker members and the speed of the carriage are at least approximately the same. Such a speed control may be achieved, for example, by a chain or gear drive. The breaker members and the carriages may, however, have their own separate drive motors.

In order to remove the fiber tufts (obtained from the bales during the opening process) from the zone underneath the breaker members, it is advantageous to provide a vacuum (suction) device which travels together with the carriage.

DESCRIPTION OF THE PREFERRED EMBODIMENT

Figure 1:
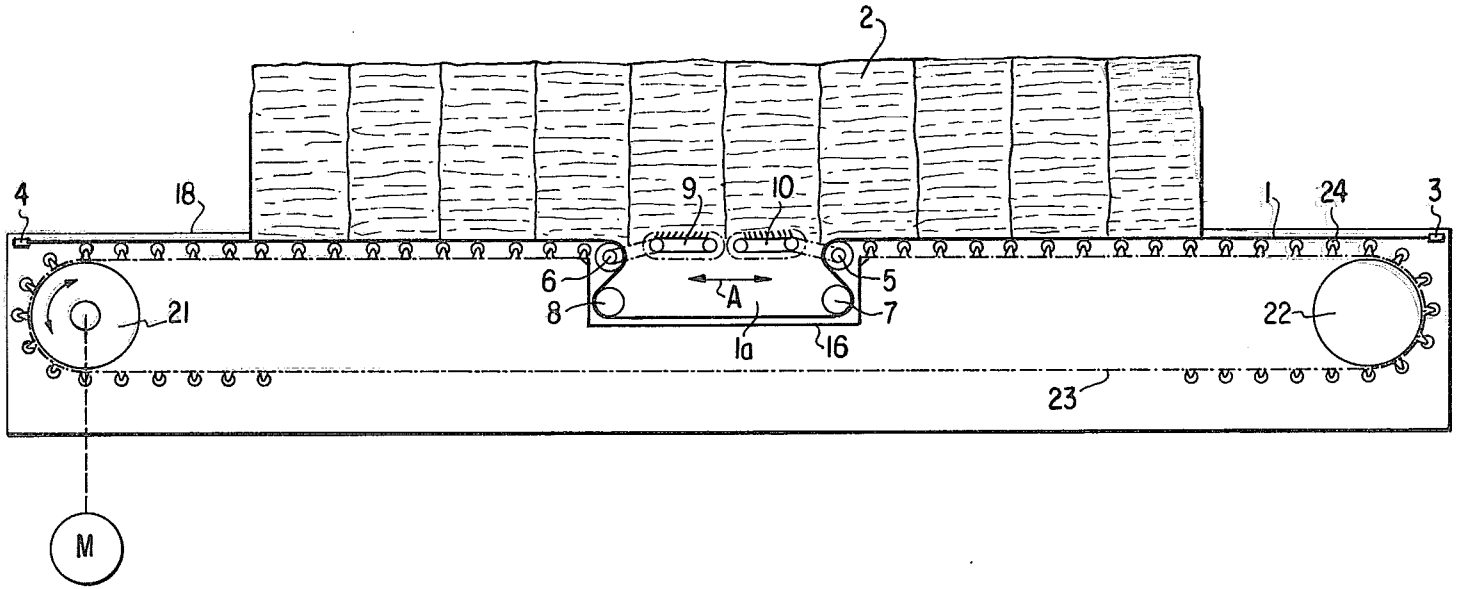
FIG. 1 is a schematic side elevational view of a preferred embodiment of the invention.

Turning now to FIG. 1, a series of juxtapositioned textile fiber bales 2 is supported on a flexible underlay 1 which is constituted by a strong flexible sheet and which, at its opposite ends 3 and 4, is affixed to the frame 18 of the bale breaker machine. Between the ends 3 and 4 there are provided two horizontal deflecting rolls 5 and 6, the axes of which are parallel and extend perpendicularly to the working direction of the bale breaker apparatus. Underneath the deflecting rolls 5 and 6, there are provided two additional deflecting rolls 7 and 8 in a likewise orientation. The sheet 1 is trained about the deflecting rolls 5, 6, 7 and 8 in such a manner that it forms a loop which, in the zone in which the sheet 1 carries the bales 2, defines an upwardly open chamber 1*a*. In the chamber 1*a* defined by one part of the sheet 1, there are arranged two spiked breaker aprons 9 and 10, the length of which approximately corresponds to the length of one bale 2.

Figure 2:
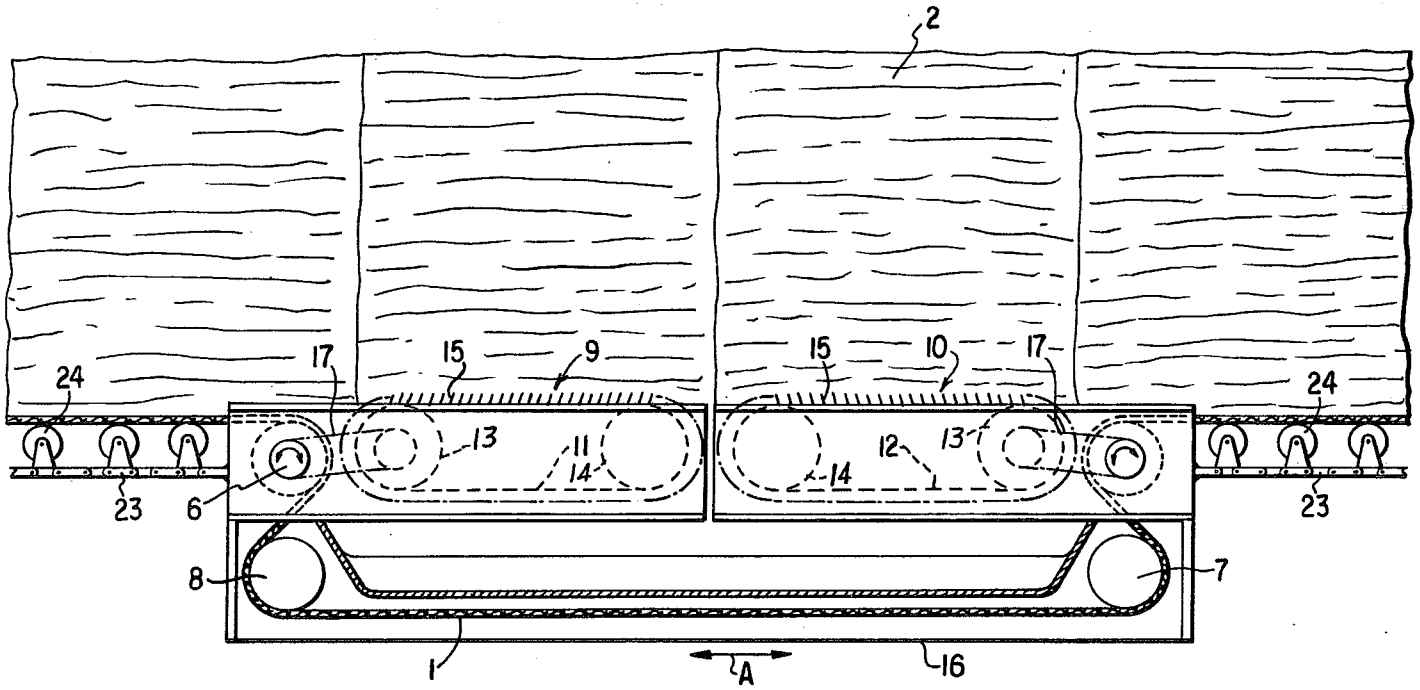
FIG. 2 is a schematic side elevational view of a detail of FIG. 1, on an enlarged scale.

Turning now to FIG. 2, each breaker apron 9 and 10 comprises a respective endless belt 11 and 12, the width of which is somewhat greater than that of a bale 2. Each breaker apron further has a driven roll 13 and an idle roll 14 about which the respective endless apron belts 11 and 12 are trained. The direction of rotation of the rolls 13 and 14 as well as their rpm are variable. The belts 11 and 12 are each provided with a plurality of spikes 15, the length of which may be, for example, 35 mm. All the spikes 15 are oriented at an oblique inclination with respect to the direction of travel of the belts 11 and 12 and further, the spikes on the belt 11 are of opposite orientation with respect to the spikes on the adjoining belt 12. The distance between adjoining breaker aprons 9 and 10 may be steplessly varied by shifting the breaker aprons 9 and 10 with respect to one another.

The breaker aprons 9 and 10 are supported on a carriage 16 which is movable in the working direction on the frame 18 of the bale breaker apparatus. The carriage 16 is driven by a chain 23 which is trained about two end rollers 21 and 22, one of which is driven by a motor M whose speed is steplessly variable. To the outwardly oriented side of the chain 23 there are secured support rolls 24 which serve as a backing for the sheet 1. By virtue of the motion of the carriage 16, the deflecting rolls 5 and 6 are entrained in rotation and, by means of respective chains 17 they drive the rolls 13 and 14 of the breaker aprons 9 and 10. In this manner, the drive of the carriage 16 and that of the breaker aprons 9 and 10 is connected together so that a positive drive is effected between the advance of the carriage 16 and the traveling speed of the apron belts 11 and 12. In this manner, the advancing speed of the carriage 16 and the running speed of the apron belts 11 and 12 are identical.

Figure 3:
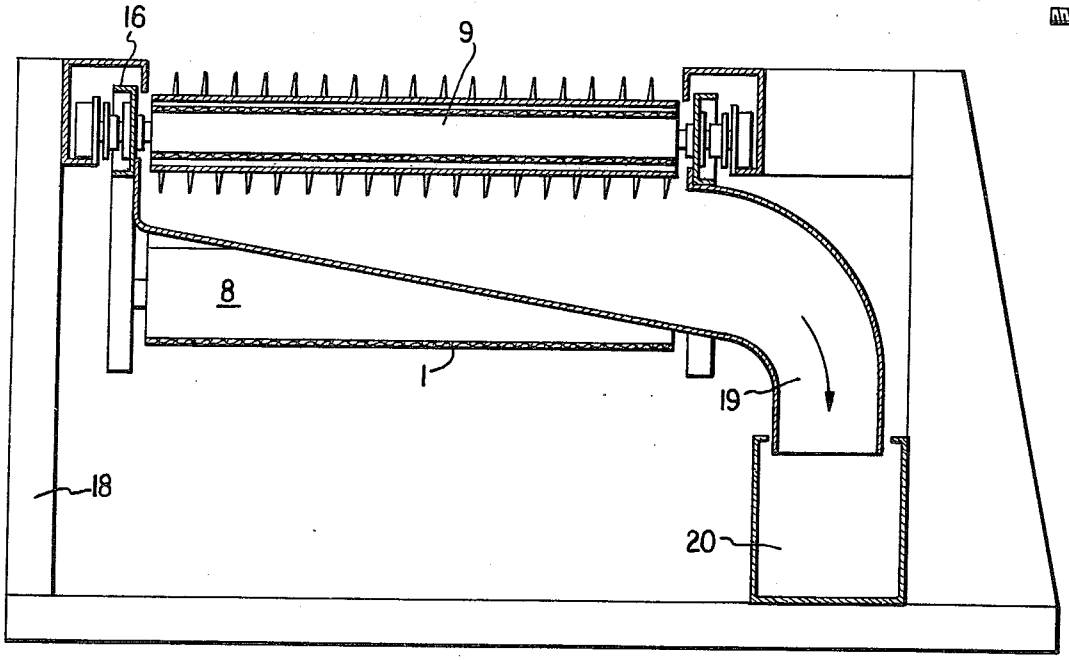
FIG. 3 is a schematic cross-sectional front elevational view of the same embodiment.

After a plurality of bales 2 (ten in this example) are positioned on the sheet 1, both breaker aprons 9 and 10 are driven with identical speeds in the same direction. As a result, the spikes 15 penetrate into the underside of the bales. At the same time, the deflecting rolls 5 and 6 are driven with identical speeds. As a result, the chamber 1*a* and the breaker aprons 9 and 10 move progressively as a unit in the one or the other sense of the working direction as indicated by the double-headed arrow A which also indicates the length dimension of the apparatus. The bales 2 remain stationary during the entire opening process. Since the spikes 15 of the breaker apron 9 move, as they emerge from a bale 2, with a significantly greater speed downwardly because of the deflection of the apron belt 11, they tear small fiber tufts out of the bale. As soon as one of the breaker aprons 9 and 10 has reached the end of the last bale 2, the drive for the rolls of the carriage 15 and the breaker aprons 9 and 10 is reversed. This may be effected, for example, by a photocell control or a limit switch. The breaker aprons 9 and 10 then move underneath the bales 2 in the opposite direction; during this operational phase, the spikes 15 of the breaker apron 10 tear out fiber tufts from the underside of the bales 2 until the breaker apron 10 has reached the terminus of the last bale 2 whereupon the drive is again reversed. The fiber tufts removed from the underside of the bales are, as shown in FIG. 3, drawn away by a suction funnel 19 into the conduit 20 and advanced therein to the successive processing station. The dimensions of the fiber tufts delivered by the suction funnel 19 may be varied by the alteration of the lengths of the spikes 15 and by the distance between the breaker aprons 9 and 10. The output rate of the device may be altered by varying the traveling speed of the breaker aprons 9 and 10.

It will be understood that the above description of the present invention is susceptible to various modifications, changes and adaptations, and the same are intended to be comprehended within the meaning and range of equivalents of the appended claims.

What is claimed is:

1. In an apparatus for breaking textile fiber bales, including a plurality of spiked breaker members; rotating means for rotating each breaker member in a working direction generally parallel to a length dimension of the apparatus; the breaker members being spaced from one another parallel to the working direction; support means for receiving a series of bales juxtapositioned parallel to the working direction for exposing the underside of the bales to the breaker members; the improvement comprising (a) a flexible underlay extending parallel to the working direction for engaging face-to-face the underside of the bales; said flexible underlay forming at least one part of said support means and being immobilized for substantially preventing displacement of said flexible underlay as a whole parallel to the working direction;

(b) means forming an upwardly open chamber of one part of said flexible underlay; said breaker members being accommodated in said chamber for engaging the underside of the bales situated at least in part within the outline of the chamber opening; and (c) displacing means for moving said chamber and said breaker members as a unit parallel to the working direction.

2. An apparatus as defined in claim 1, further comprising means for steplessly varying the spacing between said breaker members.

3. An apparatus as defined in claim 1, further comprising means for steplessly varying the rotational speed of said breaker members.

4. An apparatus as defined in claim 1, further comprising means for steplessly varying the speed of the displacement of said chamber and said breaker members parallel to the working direction.

5. An apparatus as defined in claim 1, further comprising a vacuum means for carrying away fiber tufts removed from the bales by said breaker members; said vacuum means being arranged for traveling with said breaker members parallel to the working direction.

6. An apparatus as defined in claim 1, wherein said flexible underlay is a sheet having opposite ends; said sheet being immobilized at said ends.

7. An apparatus as defined in claim 6, wherein said sheet is constituted of a multilayer material.

8. An apparatus as defined in claim 1, wherein said means forming an upwardly open chamber comprises a plurality of deflecting rolls engaging and deflecting said underlay for forming an upwardly open loop therein; said upwardly open loop defining said upwardly open chamber.

9. An apparatus as defined in claim 8, wherein said deflecting rolls comprise first and second deflecting rolls spaced horizontally parallel to the working direction and engaging said underlay on a first side thereof; at least one third deflecting roll situated below the level of said first and second rolls and engaging said underlay on a second, opposite side thereof.

10. An apparatus as defined in claim 1, further comprising (d) a carriage supported in the apparatus for movement parallel to the working direction; said breaker members being supported in said carriage for movement therewith as a unit; and (e) drive means for displacing said carriage, said breaker members and said upwardly open chamber as a unit parallel to the working direction; said drive means and said carriage being included in said displacing means.

11. An apparatus as defined in claim 10, wherein said drive means comprises force-transmitting means for rotating said breaker members such that the speed of the displacement of said carriage and the rotational speed of said breaker members parallel to the working direction are at least approximately identical; said drive means and said force-transmitting means being included in said rotating means.

12. An apparatus as defined in claim 10, wherein said drive means comprises (a) a chain means attached to said carriage;

(b) means supporting said chain means; and (c) motor means driving said chain means.

13. An apparatus as defined in claim 12, wherein said chain means has a portion extending parallel to the working direction immediately underneath said underlay; the improvement further comprising a plurality of support rollers secured to said chain means and engaging said underlay at locations externally of the underlay part defining said upwardly open chamber.

14. An apparatus as defined in claim 12, wherein said means forming an upwardly open chamber comprises a plurality of deflecting rolls mounted on said carriage; said deflecting rolls engaging and deflecting said underlay for forming an upwardly open loop therein; said upwardly open loop defining said upwardly open chamber; said deflecting rolls being entrained in rotation by the stationary underlay upon displacement of said carriage; and force-transmitting means connecting said breaker members with at least one of said deflecting rolls for rotating said breaker members; said drive means, said at least one deflecting roll and said force-transmitting means being included in said rotating means.

15. An apparatus as defined in claim 14, wherein said force-transmitting means is so dimensioned that the speed of the displacement of said carriage and the rotational speed of said breaker members in the working direction are at least approximately identical.

* * * * *

UNITED STATES PATENT AND TRADEMARK OFFICE

CERTIFICATE OF CORRECTION

PATENT NO. : 4,190,933

DATED : March 4th, 1980

INVENTOR(S) : Peter Jagst

It is certified that error appears in the above-identified patent and that said Letters Patent are hereby corrected as shown below:

Column 2, line 17, change "so" to --no--.

Figure 4:
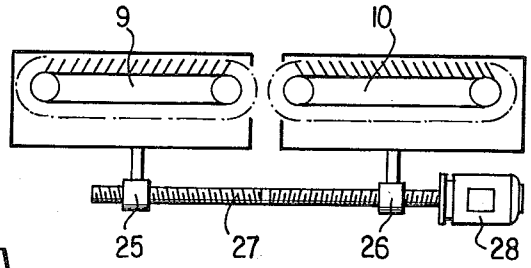
FIG. 4 shows a setting member for altering the distance between the points of the spikes of the breaker aprons 9, 10. For this purpose nuts 25 and 26 are fixedly attached to the breaker aprons 9 and 10, respectively. The nuts 25 and 26 run on a common threaded spindle 27 which is driven by a motor 28. The nut 25, as well as the spindle zone associated with the nut 25 have a matching left-hand thread, while the nut 26 as well as the spindle zone associated with the nut 26 have a matching right-hand thread. Upon rotation of the motor 28 there is effected, by virtue of the rotation of the spindle 27, a displacement of the nuts 25 and 26 and thus a displacement of the aprons 9 and 10.

Column 3, lines 14-15, change to read: --Fig. 4 is a schematic side elevational view of a detail of Fig. 1.--

Column 4, after line 48, insert:
--Fig. 4 shows a setting member for altering the distance between the points of the spikes of the breaker aprons 9, 10. For this purpose nuts 25 and 26 are fixedly attached to the breaker aprons 9 and 10, respectively. The nuts 25 and 26 run on a common threaded spindle 27 which is driven by a motor 28. The nut 25, as well as the spindle zone associated with the nut 25 have a matching left-hand thread, while the nut 26 as well as the spindle zone associated with the nut 26 have a matching right-hand thread. Upon rotation of the motor 28 there is effected, by virtue of the rotation of the spindle 27, a displacement of the nuts 25 and 26 and thus a displacement of the aprons 9 and 10.--

Signed and Sealed this

*Third* Day of *March 1981*

[SEAL]

*Attest:*

*Attesting Officer*

RENE D. TEGTMEYER

*Acting Commissioner of Patents and Trademarks*